US008818009B2

(12) United States Patent
Gilbert et al.

(10) Patent No.: US 8,818,009 B2
(45) Date of Patent: Aug. 26, 2014

(54) DUAL DIAPHRAGM DYNAMIC MICROPHONE TRANSDUCER

(71) Applicant: Shure Acquisition Holdings, Inc., Niles, IL (US)

(72) Inventors: Mark W. Gilbert, Park Ridge, IL (US); Charles S. Argento, Chicago, IL (US); Roger Stephen Grinnip, III, Lake Zurich, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 13/658,506

(22) Filed: Oct. 23, 2012

(65) Prior Publication Data

US 2014/0112515 A1 Apr. 24, 2014

(51) Int. Cl.
*H04R 9/08* (2006.01)

(52) U.S. Cl.
USPC ..... 381/357; 381/186; 381/423; 381/430; 181/163

(58) Field of Classification Search
USPC ..... 381/186, 357, 423, 430; 181/163
See application file for complete search history.

(56) References Cited

U.S. PATENT DOCUMENTS

| | | | | |
|---|---|---|---|---|
| 2,003,908 | A * | 6/1935 | Smith | 181/167 |
| 2,627,558 | A * | 2/1953 | Wiggins | 381/357 |
| 3,115,207 | A * | 12/1963 | Wiggins | 381/357 |
| 3,995,124 | A | 11/1976 | Gabr | |
| 4,401,859 | A * | 8/1983 | Watson | 381/353 |
| 6,091,828 | A * | 7/2000 | Akino et al. | 381/355 |
| 7,079,663 | B1 | 7/2006 | Epping et al. | |
| 8,098,871 | B2 | 1/2012 | Akino | |
| 2006/0182303 | A1 | 8/2006 | Trandafir | |
| 2008/0267431 | A1 | 10/2008 | Leidl et al. | |
| 2013/0230199 | A1 | 9/2013 | Stirnemann | |

FOREIGN PATENT DOCUMENTS

| | | | |
|---|---|---|---|
| DE | 2451307 | A1 | 5/1976 |
| DE | 102005008511 | A1 | 8/2006 |
| WO | 2011/015674 | A1 | 2/2011 |

OTHER PUBLICATIONS

Electro-Voice® Microphones, Electro-Voice, Inc., Technical Data Sheet No. 20—Models 726, 731—Dynamic Type, Buchanan, Michigan, (n.d.) pp. 1-3.

International Search Report and Written Opinion for International Patent Application No. PCT/US2013/057209, dated Oct. 14, 2013, eight pages.

* cited by examiner

*Primary Examiner* — Curtis Kuntz
*Assistant Examiner* — Ryan Robinson
(74) *Attorney, Agent, or Firm* — Neal, Gerber & Eisenberg LLP

(57) ABSTRACT

A dual diaphragm dynamic type microphone transducer that, among other things, provides control of source/receiver proximity effects without sacrificing professional level dynamic microphone performance.

22 Claims, 8 Drawing Sheets

FIG. 1
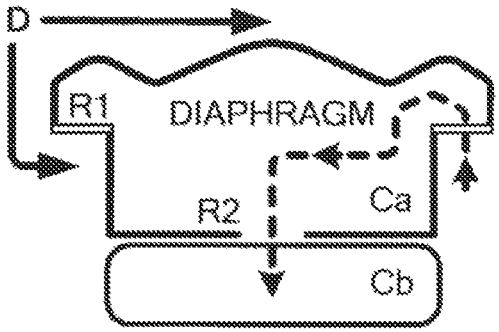
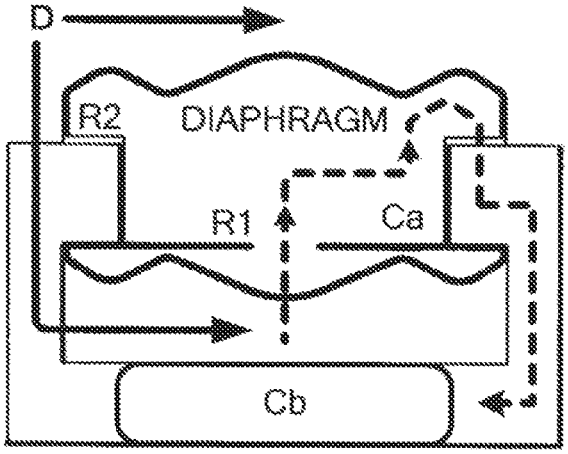
FIG. 2
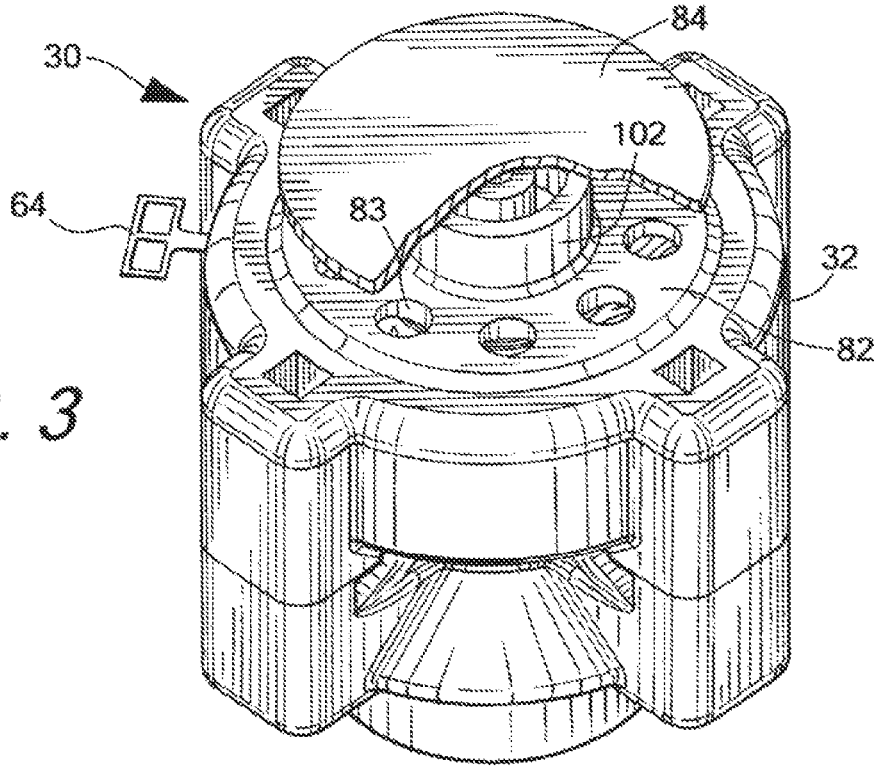
FIG. 3

DUAL DIAPHRAGM DYNAMIC MICROPHONE TRANSDUCER

TECHNICAL FIELD

This application generally relates to a dynamic microphone transducer. In particular, this application relates to a dual diaphragm dynamic microphone transducer.

BACKGROUND

There are several types of microphones and related transducers, such as for example, dynamic, crystal, condenser/capacitor (externally biased and electret), etc., which can be designed with various polar response patterns (cardioid, supercardioid, omnidirectional, etc.) All of these types have their advantages and disadvantages depending on the application. Condenser microphones are able to respond to very high audio frequencies, and they are usually much more sensitive than dynamic microphones, making them more suitable for quieter or distant sound sources. Such frequency responses are possible because the diaphragms of condenser microphone transducers can typically be made thinner and lighter than those of dynamic models due to the fact that, unlike dynamic models, the diaphragms do not have the mass of a voice coil attached thereto within the acoustical space of the transducer. On the other hand, one of the advantages of dynamic microphones is that they are passive and therefore do not require active circuitry to operate. As such, dynamic microphones are generally robust, relatively inexpensive, and less prone to moisture/humidity problems. They also exhibit a potentially high gain before feedback becomes a problem. These attributes make them ideal for on-stage use.

A phenomenon that all directional microphone transducer designs must contend with is called the "proximity effect." The proximity effect is an increase in low frequency (bass) response when the microphone is used close to the sound source. This increased response is caused by the fact that directional microphones also capture sound waves from the rear of the transducer capsule, which is delayed in an acoustic passage or port and then added to the sound energy arriving on-axis. When the sound source is relatively distant, the phase shift introduced by the acoustic passage causes sound waves arriving from the rear to primarily be cancelled out when substantially the same sound levels arrive at the front and rear of the microphone transducer. For relatively close sound sources, however, the inverse square law dictates that there will be an increased sound level at the front of the microphone transducer than the sound level at the rear. This reduces the efficiency of the port in cancelling low frequencies. Pragmatically speaking, a vocalist, speaker, musical instrument or other sound source that is positioned close to the microphone will produce a significant amount of bass response.

The typical strategy for dealing with the proximity effect is to reduce low frequency output (high pass) either electrically or mechanically through increased mechanical resonance. One mechanical strategy employs an additional compliance element, such as a second diaphragm, which can be placed in series with the rear port tuning impedance to control the proximity effect. Such dual diaphragm microphone transducers, however, have been limited to condenser-type microphone applications because of the smaller size and simplicity of the acoustical space within condenser microphone transducers.

There is a need for a dual diaphragm dynamic type microphone transducer that, among other things, provides control of source/receiver proximity effects without sacrificing professional level dynamic microphone performance.

SUMMARY

In an embodiment, a dual diaphragm microphone transducer comprises a housing and a transducer assembly supported within the housing to accept acoustic waves. The transducer assembly comprises a magnet assembly, a front diaphragm having a rear surface disposed adjacent the magnet assembly, and a rear diaphragm having a rear surface opposingly disposed adjacent the magnet assembly with respect to the rear surface of the front diaphragm. A front surface of the front diaphragm is configured to have acoustic waves impinge thereon and the rear surface has a coil connected thereto such that the coil is capable of interacting with a magnetic field of the magnet assembly. A front surface of the rear diaphragm is configured to have acoustic waves impinge thereon. The transducer assembly defines an internal acoustic space in communication with a cavity within the housing via at least one air passage in the housing.

In another embodiment, the housing further comprises a resonator having at least one aperture therein and disposed over the front surface of the front diaphragm.

In another embodiment, the housing further comprises a diffractor plate disposed outwardly offset from and adjacent to the front surface of the front diaphragm.

In yet another embodiment, the front diaphragm comprises a central dome portion and an outer compliance ring portion, and the compliance ring portion of the front diaphragm has a cross-sectional profile having a variable radius of curvature.

In yet another embodiment, the rear diaphragm comprises a central dome portion and an outer compliance ring portion, and the compliance ring portion of the rear diaphragm has a cross-sectional profile having a variable radius of curvature.

In yet another embodiment, the front diaphragm and the rear diaphragm each comprise a central dome portion and an outer compliance ring portion, and the central dome portion of the rear diaphragm is smaller than the central dome portion of the front diaphragm.

These and other embodiments, and various permutations and aspects, will become apparent and be more fully understood from the following detailed description and accompanying drawings, which set forth illustrative embodiments that are indicative of the various ways in which the principles of the invention may be employed.

BRIEF DESCRIPTION OF THE DRAWINGS

FIG. 1 is a schematic diagram illustrating the topology of a single diaphragm dynamic microphone transducer, including an external delay distance D between a front surface of the diaphragm and a rear surface of the diaphragm and an acoustical path shown in dotted line.

FIG. 2 is a schematic diagram illustrating the topology of a dual diaphragm dynamic microphone transducer in accordance one or more principles of the invention, including an external delay distance D between a front surface of a front diaphragm and a front surface of a rear diaphragm and an acoustical path shown in dotted line.

FIG. 3 is a perspective view of an embodiment of a dual diaphragm microphone transducer in accordance with one or more principles of the invention, having a portion of a diffractor plate cut away to reveal a portion of a resonator of the transducer.

DETAILED DESCRIPTION

Figure 4:
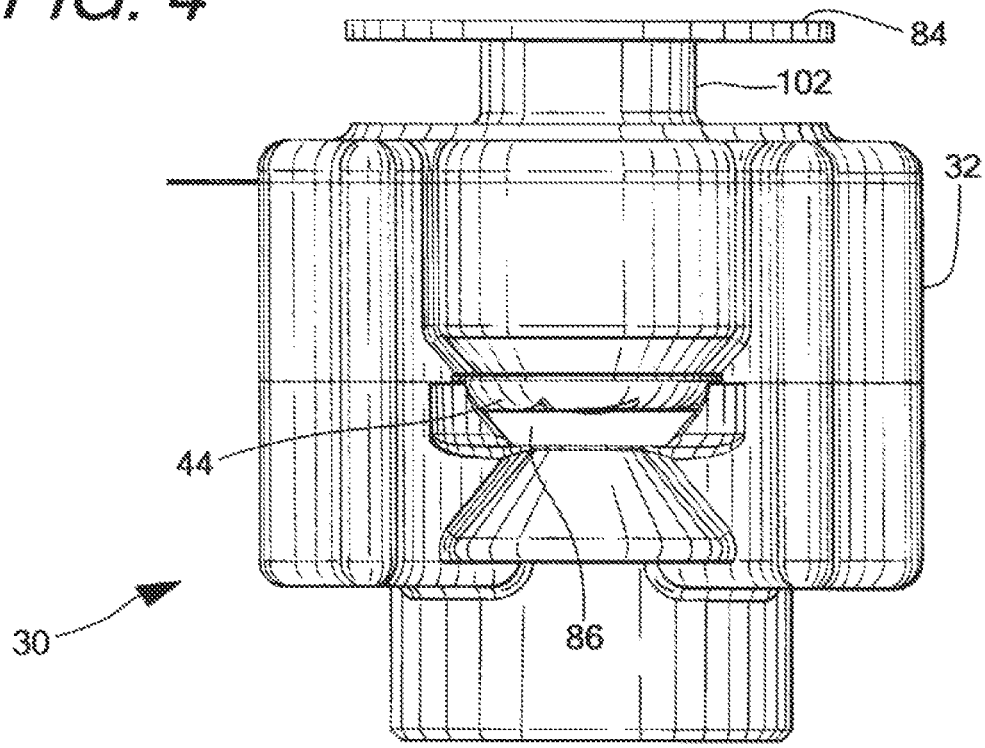
FIG. 4 is an elevational view of the dual diaphragm microphone transducer embodiment depicted in FIG. 3.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

In accordance with one or more principles of the invention, a dual diaphragm dynamic microphone transducer is disclosed herein, which provides in certain embodiments, and among other things, a single capsule, professional level unidirectional microphone with an optimal means of controlling source/receiver proximity effects and off-axis rejection at a reference source proximity.

FIG. 1 illustrates the toplogy of a typical single diaphragm microphone transducer design, which is shown in comparison to the topology of a dual diaphragm microphone transducer as shown in FIG. 2 for didactic purposes. FIG. 2 illustrates a more complex topology of a dual diaphragm dynamic microphone transducer. As shown in the single diaphragm model in FIG. 1, a first acoustical compliance Ca is defined behind the diaphragm and is in acoustical communication with a second compliance Cb in the form of a cavity. An acoustic flow of the system is illustrated by the dotted line shown in FIG. 1. An acoustic delay D of the system is defined by the distance between the front surface of the diaphragm and a secondary tuning port represented by resistance (RI). In the single diaphragm system, an external delay of the acoustic waves, defined by distance D, is relatively short. In comparison, FIG. 2 illustrates a system with an increased external delay D and a "reversed" acoustic flow through the phase shift network caused by the introduction of a dual diaphragm model. These complexities and constraints must be accounted for to achieve professional level performance of the dual diaphragm design. Among other things, the external delay is to be minimized while retaining adequate internal cavity volume in the design.

In accordance with one or more principles of the invention, a dual diaphragm dynamic microphone transducer is disclosed herein, that, among other things, achieves professional level performance. In particular embodiments, the transducer exhibits a uniform, full bandwidth (50 Hz≤f≤15 kHz) frequency response, optimal sensitivity (S≥−56 dBV/Pa for vocal applications) and low output impedence ($Z_{out}$≤300Ω) without active amplification (phantom power), and extended bandwidth rejection in the desired polar pattern (e.g. Δ≥25 dB for cardioid operation). In addition to the benefits of incorporating a series rear port compliance element, particular embodiments exhibit reduced proximity effect and have a tunable reference distance for optimal off-axis rejection.

Figure 5:
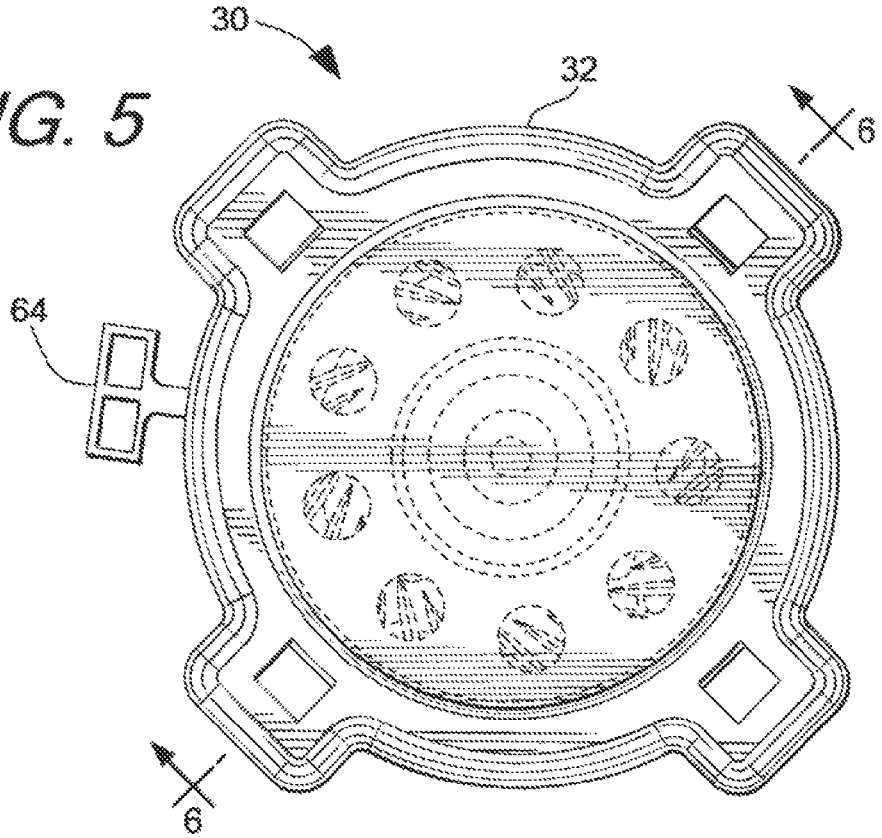
FIG. 5 is a top plan view of the dual diaphragm microphone transducer embodiment depicted in FIG. 3.
Figure 6:
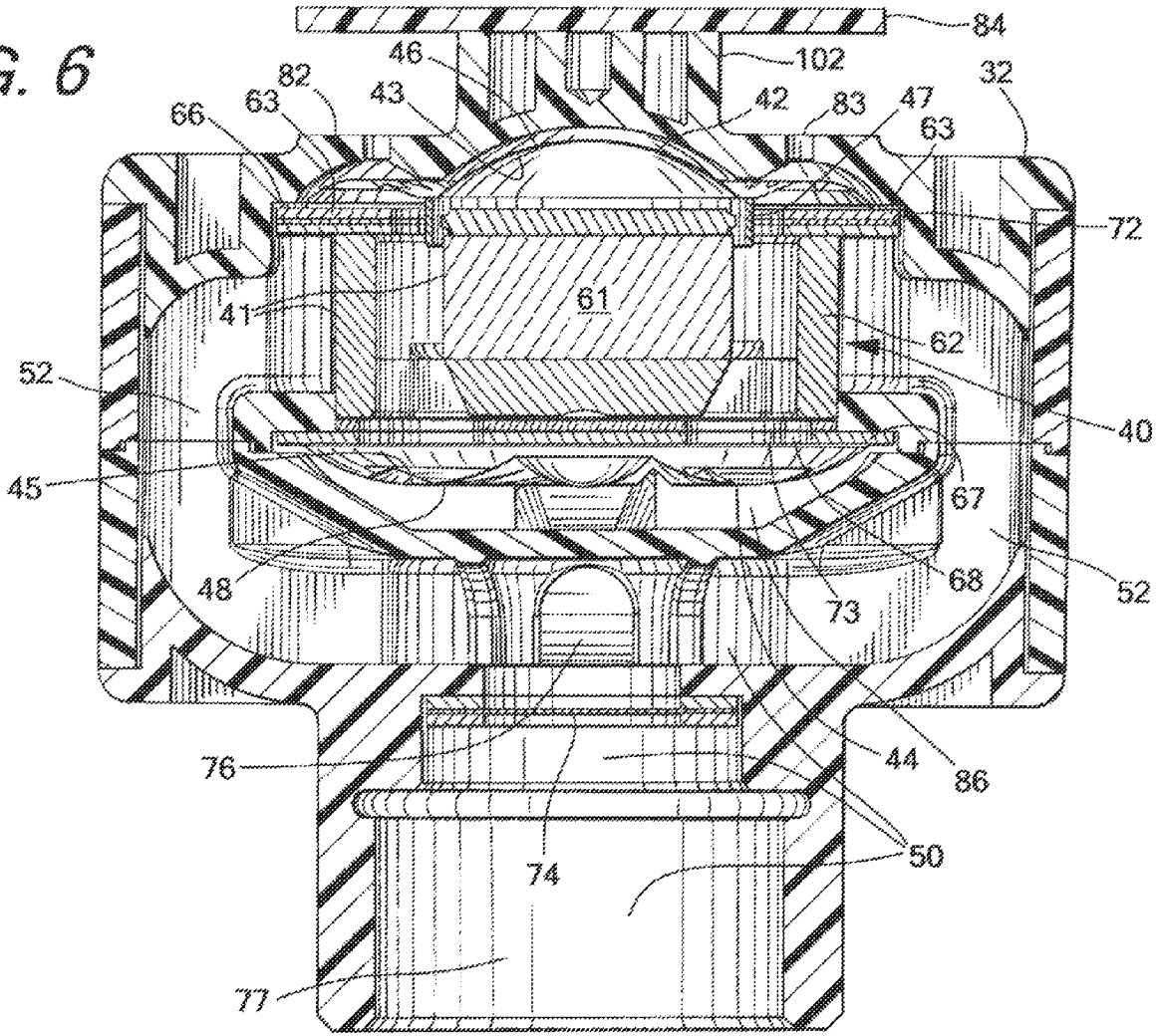
FIG. 6 is an elevational cross-section view of the dual diaphragm microphone transducer embodiment depicted in FIG. 3 and taken along section line 6-6 in FIG. 5.

With general reference to FIGS. 3-7, a single capsule, dual diaphragm dynamic microphone transducer 30 has a housing 32 and a transducer assembly 40 supported within the housing to accept acoustic waves. As shown in FIG. 6, the transducer assembly 40 comprises a magnet assembly 41, a front diaphragm 42 having a rear surface 43 disposed adjacent the magnet assembly 41, and a rear diaphragm 44 having a rear surface 45 opposingly disposed adjacent the magnet assembly 41 with respect to the rear surface 43 of the front diaphragm 42. A front surface 46 of the front diaphragm 42 is configured to have acoustic waves impinge thereon and the rear surface has a coil 47 connected thereto such that the coil 47 is capable of interacting with a magnetic field of the magnet assembly 41. A front surface 48 of the rear diaphragm 44 is also configured to have acoustic waves impinge thereon. The transducer assembly 40 defines an internal acoustic network space in communication with a cavity 50 within the housing 32 via at least one air passage 52 in the housing 32. In the embodiment shown, four air passages 52 are implemented in the housing 32.

Figure 7:
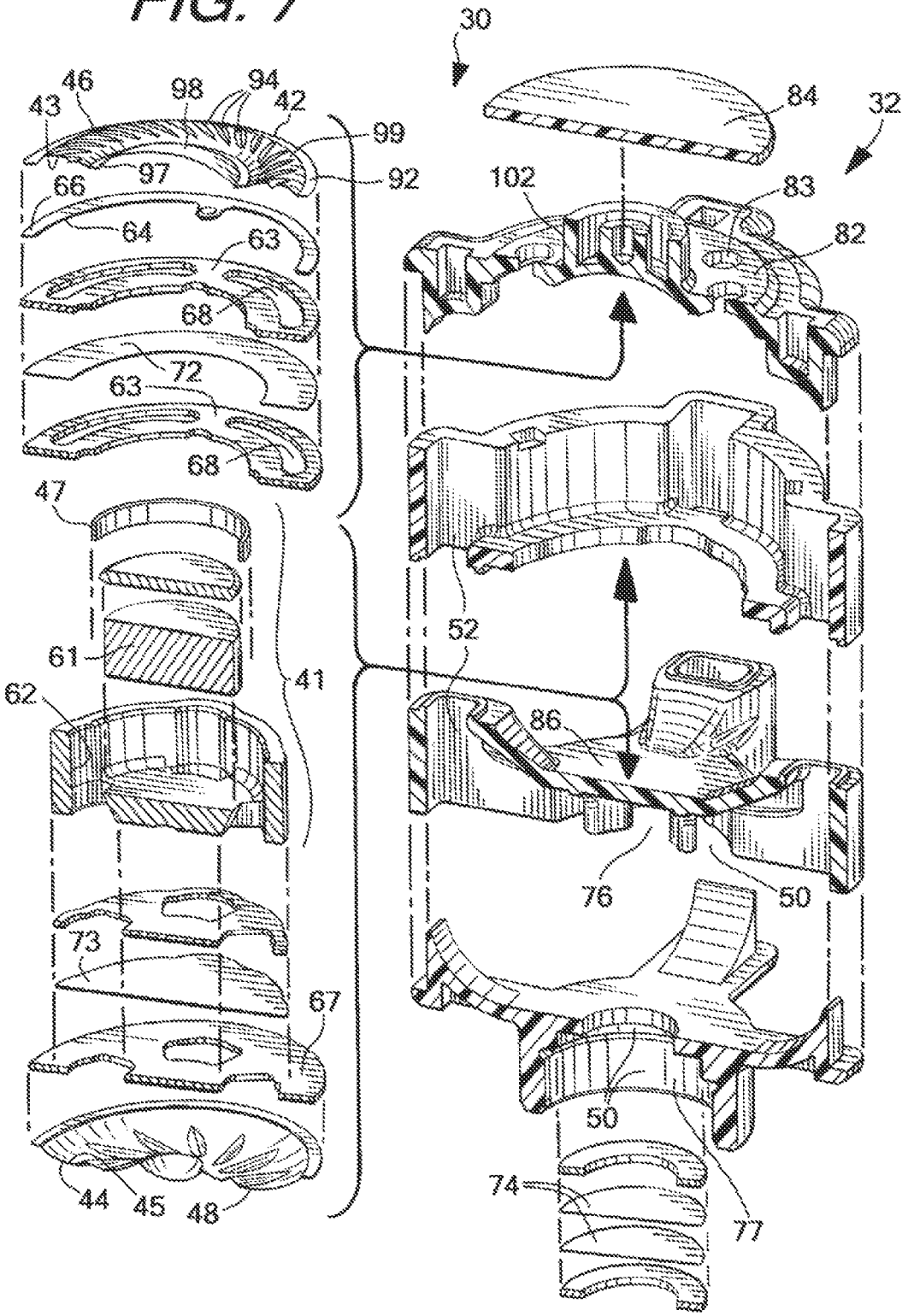
FIG. 7 is an exploded assembly view of the cross section depicted in FIG. 6.

Referring to additional aspects of a particular embodiment, and with reference to FIGS. 6 and 7, the magnet assembly 41 of the particular embodiment illustrated includes a centrally disposed magnet 61 having its poles arranged vertically generally along a central vertical axis of the housing 32. An annularly-shaped bottom magnet pole piece 62 is positioned concentrically outwardly from the magnet 61 and has a magnetic pole the same as the magnetic pole of the upper portion of the magnet 61. In this embodiment, a top pole piece 63 is disposed upwardly adjacent to the bottom pole piece and has a magnetic pole opposite that of the upper portion of the magnet 61. In this embodiment, the top pole piece 63 comprises two pieces, but in other embodiments, it may comprise one piece or a number of pieces. As can be seen from FIG. 6, when the front diaphragm has acoustic waves impinge thereon, the coil 47 moves with respect to the magnet assembly 41 and its associated magnetic field to generate electrical signals corresponding to the acoustic waves. The electrical signals can be transmitted via a coil connection and associated terminal lead 64 as shown in FIGS. 3-5.

As shown in the particular embodiment illustrated in FIGS. 6 and 7, the front diaphragm 42 is mounted to the transducer assembly 40 via a front diaphragm mount 66. The rear diaphragm 44 is mounted to the transducer assembly 40 via a rear diaphragm mount 67. The rear diaphragm mount 67 includes at least one aperture 68 therein.

The transducer 30 includes an internal acoustical network generally defined by the transducer assembly 40, which is in acoustic communication with the cavity 50. As shown in FIGS. 6 and 7, an interior space network associated with the transducer assembly 40 is in acoustic communication with the air passages 52 formed within the housing 32. Facilitating part of this acoustic communication between a space behind the front diaphragm 42 and a central space generally associated with the magnet assembly 41 of the transducer 40 is at least one aperture within the top pole piece 63. An acoustic resistance 72 is disposed between the two pieces of the top pole piece 63 such that the acoustic resistance 72 is encountered by acoustic waves passing through the apertures within the top pole piece 63. Another acoustic resistance 73 is disposed between the rear diaphragm mount 67 and the bottom magnetic pole piece, as shown in FIG. 6, such that the acoustic resistance 73 is encountered by acoustic waves passing through the apertures 68 within the rear diaphragm mount 67. In an embodiment, a third acoustic resistance element 74 is disposed between a first portion 76 and a second portion 77 of the cavity 50 within the housing 32.

As generally shown in FIG. 6, the transducer 30 has several internal acoustic spaces associated with it, including a primary space comprising the general volume between the resistances 72 and 73 within the transducer assembly; a secondary space comprising the general volume between the resistance 73 and the general termination of the air passages 52; and an auxiliary space comprising the cavity 50, which is defined by the first portion 76, which generally comprises the general volume after the termination of the air passages 52 and above the resistance 74, as well as the second portion 77, which generally comprises the volume below the resistance 74.

With general reference to FIGS. 3-7, and more specific reference to FIG. 3, in the embodiment illustrated, the housing 32 includes a resonator 82 having at least one aperture 83 therein. In the embodiment illustrated, the housing 32 further includes a diffractor plate 84, which assists in the acoustic performance of the transducer 30 as will be discussed herein. Among other things, the diffractor plate 84 compensates for a half wavelength resonance condition due to the acoustic space segmentation introduced by the dual diaphragm design. It also decreases the external delay distance D. FIG. 3 shows a portion of the diffractor plate 84 cut away to reveal a portion of the resonator 82 of the transducer 30 having at least one aperture 83. The front diaphragm 42, a portion of which can be seen through the apertures 83 in FIG. 3, is positioned adjacent the resonator 82 such that acoustic waves that pass through the apertures 83 impinge upon the front surface 46 of the front diaphragm 42.

As shown in FIG. 4, the rear diaphragm 44 is positioned within the housing 32 such that acoustic waves may impinge thereon. As shown in FIGS. 4 and 6, the front surface 48 of the rear diaphragm 44 sits adjacent a generally centrally located open area 86 of the housing 32. While this configuration places fewer constraints on the air passage 52 and cavity 50 configuration of the housing 32, it should be noted that other configurations are possible and contemplated herein, including without limitation, positioning the cavity to a side of the housing or concentrically around an outer portion of the housing.

Figure 8:
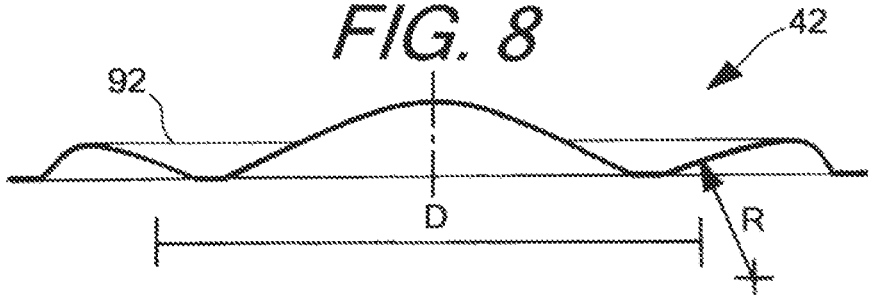
FIG. 8 is a cross-sectional profile view of the front diaphragm of the dual diaphragm microphone transducer embodiment depicted in FIG. 3, which illustrates a variable radius of curvature R of an annular compliance ring of the diaphragm, wherein R varies as a function of radius measured from a centerline of the diaphragm.
Figure 9:
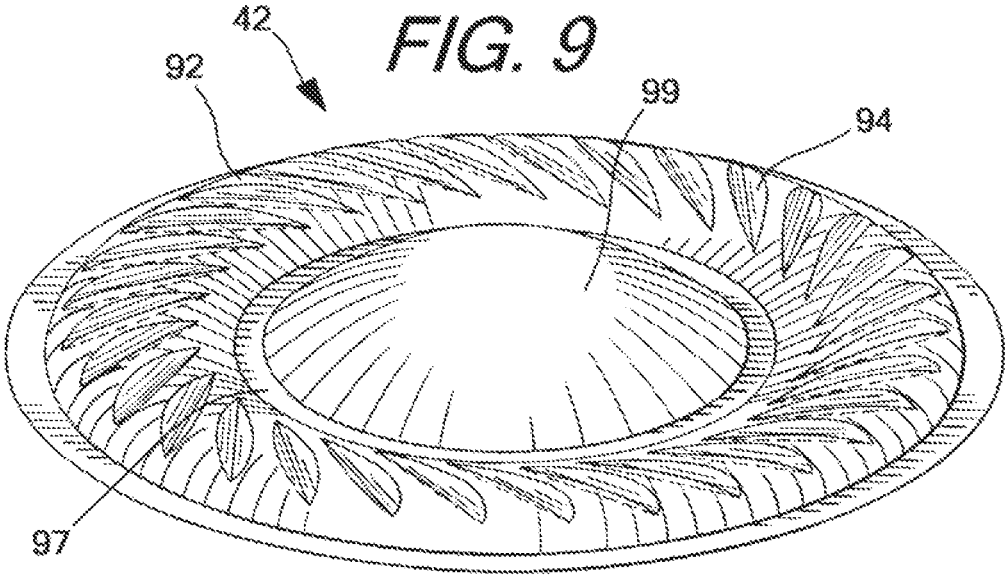
FIG. 9 is a perspective view of the front diaphragm of the dual diaphragm microphone transducer embodiment depicted in FIG. 3.
Figure 10:
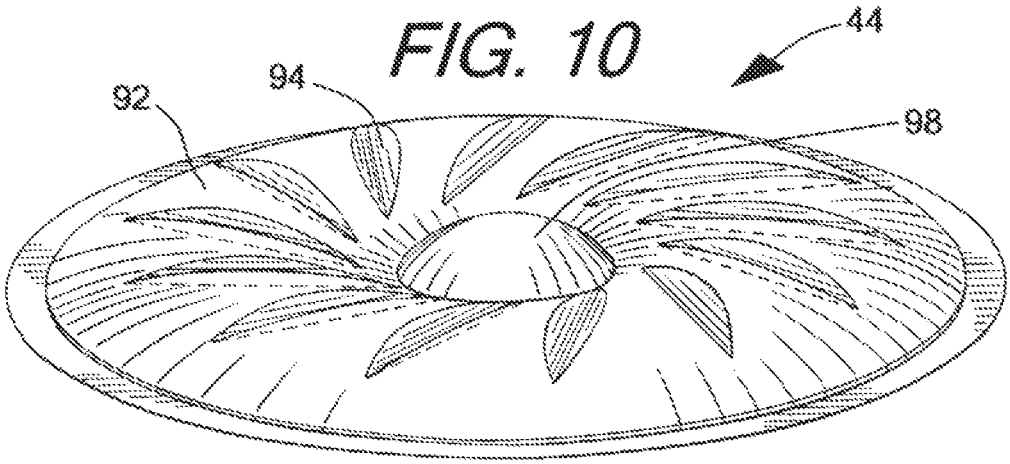
FIG. 10 is a perspective view of the rear diaphragm of the dual diaphragm microphone transducer embodiment depicted in FIG. 3.

FIGS. 8-10 illustrate aspects of the front diaphragm 42 and the rear diaphragm 44 which are incorporated in some embodiments in accordance with one or more principles of the invention. In connection with the dual diaphragm dynamic microphone transducer concept, compliance of both the front diaphragm 42 and the rear diaphragm 44 was increased over existing designs to compensate for the shift upwards in the fundamental system pole of the embodiment shown herein. A thin diaphragm material is therefore preferably employed. Additionally, as exemplified by the profile of the front diaphragm 42 shown in FIG. 8, the diaphragm also preferably employs a compliance ring portion 92 that has a variable radius of curvature R to increase stiffness of the outer diameter of the diaphragm. Because a thin diaphragm material allows modal behavior to shift down into the audio frequency bandwidth, a number of additional features may be employed in the diaphragm profile to remedy potential modal effects. For example, the diaphragm may be constructed from thin PET, such as, for example, Mylar or Hostaphan. In an embodiment, the diaphragm is constructed from 35 gauge PET. However, other gauges/thicknesses and other materials may be employed as well in accordance with these principles. The diaphragm may also incorporate a plurality of serration elements 94 in the compliance ring portion 92 of the diaphragm. The serration elements 94 are shown as elongated indentations or cutouts of material from the diaphragm and may take on other forms or geometries as well. With respect to the front diaphragm 42, a blank of material (not shown) may be disposed over a coil attachment flat 97 of the front diaphragm. The blank may be formed from any suitable thin material, such as a polyester film, such as Melinex. With respect to the rear diaphragm 44, consideration was given to the fact that increased compliance over typical dynamic microphone diaphragms is desirable to achieve the desired bandwidth requirements and the tunable reference distance for optimal off-axis rejection. Consideration was also given to the mass of the rear diaphragm 44, particularly because it does not have an attached coil. In the embodiment shown, a dome portion 98 of the rear diaphragm has a smaller diameter than that of a dome portion 99 of the front diaphragm and, due to the fact that it does not have a coil attached thereto, does not include a flat portion to accommodate attachment of a coil.

As noted above, the diffractor plate 84 compensates for a half wavelength resonance condition due to acoustic space segmentation introduced by the dual diaphragm design. This is accomplished by the fact that the diffractor plate 84 creates a similar effect over the front diaphragm 42, allowing the responses of both diaphragms to track. The diffractor plate 84 also advantageously decreases the external delay distance D. High frequency performance modifications are possible through slight modifications to the diffractor plate 84. In general, the modifications perturb the series radiation inertance as well as external delay distance D. When the outside diameter of the diffractor plate 84 increases, the radiation inertance in series with the resonator aperture 83 inertance slightly increases, lowering the resonator resonance frequency. This decreases the high frequency response (f≥10 kHz) as well as slightly decreasing the external delay. There is, however, a minimum outside diameter at which the half wavelength resonance condition reemerges. The height of the diffractor plate 84, established in the embodiment shown in FIGS. 3-7 by a neck portion 102 of the housing 32, has a similar effect. When the height increases, the series radiation inertance decreases and the external delay increases. The converse is also true.

The dual diaphragm dynamic microphone transducer preferably strikes a balance between low radiation inertance associated with both the front diaphragm 42 and the rear diaphragm 44 and a minimal external delay. A boundary element (BE) numerical simulation tool was used to characterize the radiation impedance loading the diaphragms of a sample dual diaphragm microphone transducer embodiment designed in accordance with one or more principles of the invention (without a resonator 83 such that the front surface 46 of the front diaphragm 42 was substantially exposed). The radiation inertance of the rear diaphragm was found to be nearly constant as shown in Table 1. Multiple frequencies (f≤1 kHz) were simulated and the radiation inertance experienced by the rear diaphragm was found to be roughly twice that seen by the front diaphragm. Since the front diaphragm was exposed (no resonator) during simulation, it therefore exhibits the lowest possible radiation inertance given the surface area.

TABLE 1

Radiation Inertance ($L_r$) boundary element simulation results for transducer (no resonator). Normal velocity imposed ($v_s$ = $1.0e^{-4}$ m/s) and diaphragm surface area $S_d = 4.39e^{-4}$ $m^2$. The frequency was limited to ka < 1.

| Frequency (Hz) | $L_{front}$ (kg/m$^4$) | $L_{rear}$ (kg/m$^4$) |
|---|---|---|
| 100 | 26.8 | 51.8 |
| 400 | 26.8 | 51.9 |
| 700 | 26.9 | 52.0 |
| 1000 | 26.9 | 52.2 |

Figure 11A:
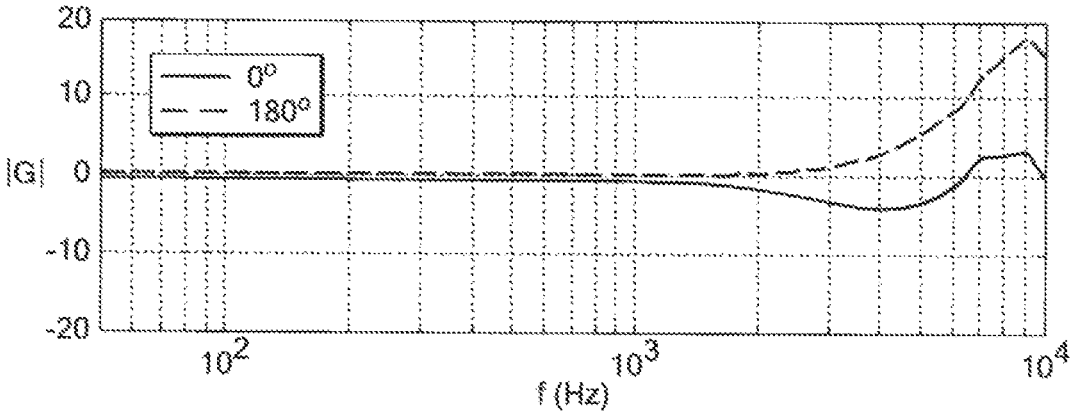
FIGS. 11*a* and 11*b* are graphs depicting external delay D and gain factor G values obtained from a boundary element simulation of an exemplary sample dual diaphragm microphone transducer embodiment designed in accordance with one or more principles of the invention without a resonator, wherein the gain factor G is defined as $\log(|P_b/P_f|)$, where $P_b$ is the average pressure over the exposed surface of the rear diaphragm and $P_f$ is the average pressure over the exposed surface of the front diaphragm.
Figure 11B:
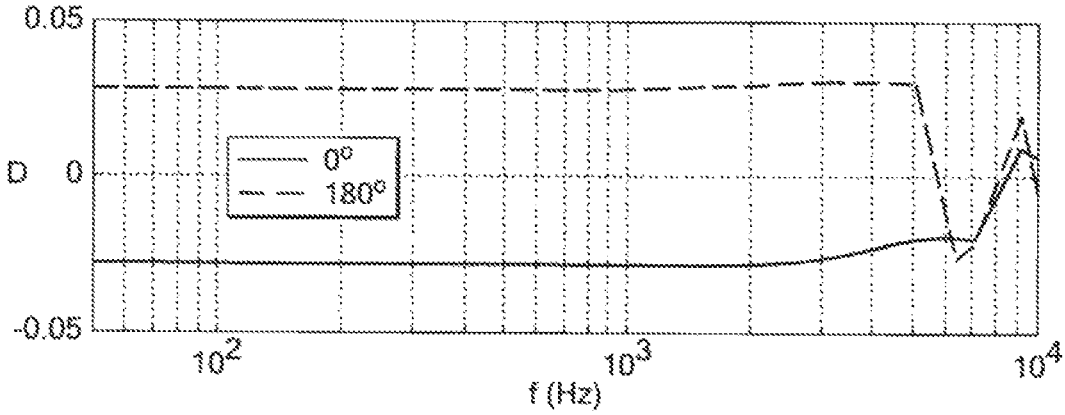

FIGS. 11*a* and 11*b* are graphs depicting external delay D and gain factor G values obtained from the boundary element simulation of an exemplary sample dual diaphragm microphone transducer embodiment designed in accordance with one or more principles of the invention (without a resonator). In these graphs, the gain factor G is defined as $\log(|P_b/P_f|)$, where $P_b$ is the average pressure over the exposed surface of the rear diaphragm and $P_f$ is the average pressure over the exposed surface of the front diaphragm.

As shown in the graphs, the external delay parameter is nearly constant (D≈0.0283 m) with frequency, ultimately collapsing at f≥5 kHz.

Figure 12A:
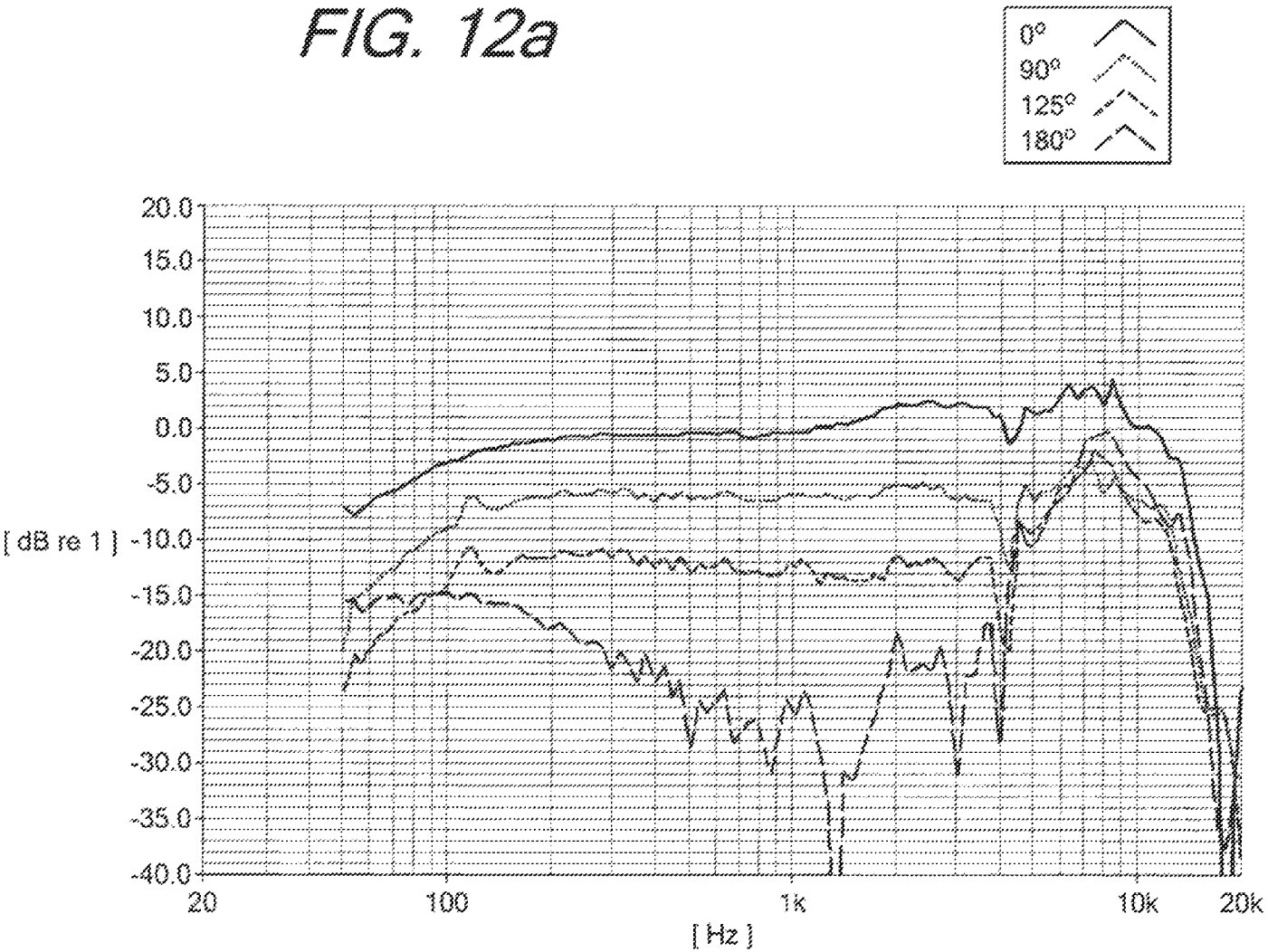
FIGS. 12*a* and 12*b* are graphs depicting the frequency response of an exemplary sample dual diaphragm microphone transducer embodiment designed in accordance with one or more principles of the invention at two source distances.
Figure 12B:
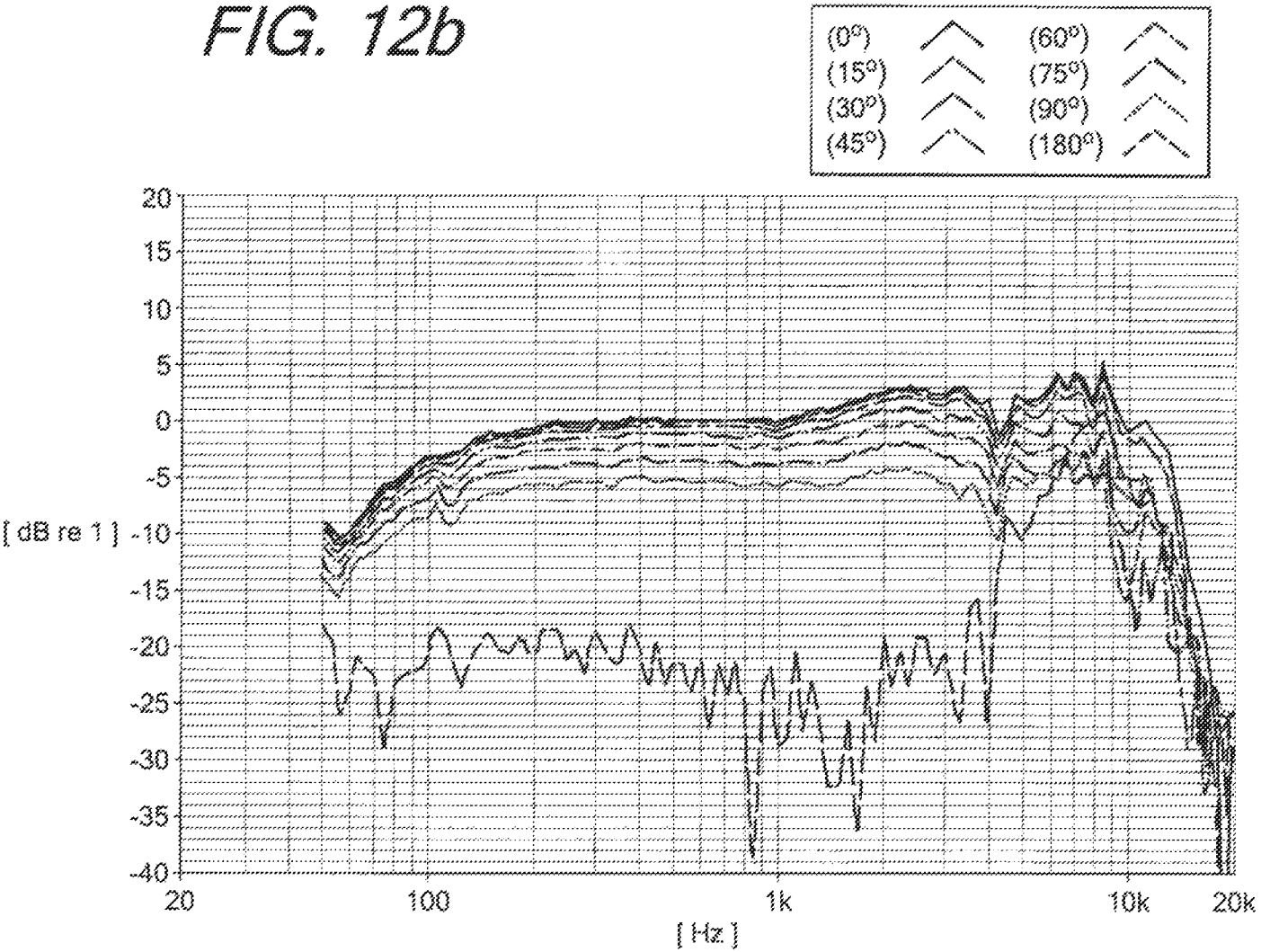

FIGS. 12*a* and 12*b* are graphs depicting the frequency response of an exemplary sample dual diaphragm microphone transducer embodiment designed in accordance with one or more principles of the invention at two source distances ($r_f$=0.6096 m and $r_f$=1.8288 m). The rear diaphragm compliance in the sample was intended to optimize off-axis rejection (θ=180°) at the reference distance $r_f$=1.8 m. As shown in the figures, the sample exhibits an improved LF rejection (f≤200 Hz) at the source distance $r_f$=1.8288 m over the closer proximity source at $r_f$=0.6096 m.

As demonstrated by these results, among other things, a single capsule, professional level uni-directional microphone with an optimal means of controlling source/receiver proximity effects and off-axis rejection at a reference source proximity has been achieved.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

What is claimed is:

1. A dual diaphragm microphone transducer comprising:

a housing; and a transducer assembly supported within the housing to accept acoustic waves, the transducer assembly comprising:

a magnet assembly;

a front diaphragm disposed adjacent the magnet assembly and having a front and rear surface, the front surface configured to have acoustic waves impinge thereon, the rear surface having a coil connected thereto such that the coil is capable of interacting with a magnetic field of the magnet assembly; and a rear diaphragm having a front and a rear surface, the rear surface opposingly disposed adjacent the magnet assembly with respect to the rear surface of the front diaphragm, the front surface configured to have acoustic waves impinge thereon;

the transducer assembly defining an internal acoustic space;

the housing having at least one air passage establishing acoustic communication between the internal acoustic space and a cavity within the housing, wherein the cavity is situated adjacent to the front surface of the rear diaphragm.

2. The transducer of claim 1, wherein the housing further comprises a resonator disposed over the front surface of the front diaphragm, the resonator having at least one aperture therein.

3. The transducer of claim 1, wherein the housing further comprises a diffractor plate disposed outwardly offset from and adjacent to the front surface of the front diaphragm.

4. The transducer of claim 1, wherein the front diaphragm comprises a central dome portion and an outer compliance ring portion.

5. The transducer of claim 4, wherein the compliance ring portion of the front diaphragm has a cross-sectional profile having a variable radius of curvature.

6. The transducer of claim 1, wherein the rear diaphragm comprises a central dome portion and an outer compliance ring portion.

7. The transducer of claim 6, wherein the compliance ring portion of the rear diaphragm has a cross-sectional profile having a variable radius of curvature.

8. The transducer of claim 1, wherein the front diaphragm and the rear diaphragm each comprise a central dome portion and an outer compliance ring portion, and wherein the central dome portion of the rear diaphragm is smaller than the central dome portion of the front diaphragm.

9. A dual diaphragm microphone transducer comprising:

a housing having a resonator with at least one aperture to allow acoustic waves from a sound source to pass therethrough; and a transducer assembly supported within the housing to accept the acoustic waves, the transducer assembly comprising:

a magnet assembly;

a front diaphragm disposed adjacent the magnet assembly and having a front and rear surface, the front surface disposed adjacent the resonator of the housing, the rear surface having a coil connected thereto such that the coil is capable of interacting with a magnetic field of the magnet assembly; and a rear diaphragm having a front and a rear surface, the rear surface disposed adjacent to and facing the magnet assembly;

the housing having at least one air passage establishing acoustic communication between a space behind the front diaphragm and a cavity in the housing, wherein the cavity is situated adjacent to the front surface of the rear diaphragm.

10. The transducer of claim 9, wherein the housing further comprises a diffractor plate disposed outwardly offset from and adjacent to the front surface of the front diaphragm.

11. The transducer of claim 9, wherein the front diaphragm comprises a central dome portion and an outer compliance ring portion.

12. The transducer of claim 11, wherein the compliance ring portion of the front diaphragm has a cross-sectional profile having a variable radius of curvature.

13. The transducer of claim 9, wherein the rear diaphragm comprises a central dome portion and an outer compliance ring portion.

14. The transducer of claim 13, wherein the compliance ring portion of the rear diaphragm has a cross-sectional profile having a variable radius of curvature.

15. The transducer of claim 9, wherein the cavity in the housing is separated into two portions via an acoustically resistive element.

16. A dual diaphragm microphone transducer comprising:

a housing having a front portion and a rear portion, the front portion having a resonator with at least one aperture to allow acoustic waves from a sound source to pass therethrough, the rear portion having a cavity formed therein; and a transducer assembly supported within the housing to accept the acoustic waves, the transducer assembly comprising:

a magnet assembly;

a front diaphragm disposed adjacent the magnet assembly and having a front and rear surface, the front surface disposed adjacent the resonator of the housing, the rear surface having a coil connected thereto such that the coil is capable of interacting with a magnetic field of the magnet assembly; and a rear diaphragm having a front and a rear surface, the rear surface disposed adjacent to and facing the magnet assembly;

the housing having at least one air passage establishing acoustic communication between a space behind the front diaphragm and the cavity within the rear portion of the housing, wherein the cavity is situated adjacent to the front surface of the rear diaphragm.

17. The transducer of claim 16, wherein the front portion of the housing further comprises a diffractor plate outwardly offset from and adjacent to the resonator.

18. The transducer of claim 16, wherein the front diaphragm has a disc-like shape comprising a central dome portion and an outer compliance ring portion.

19. The transducer of claim 18, wherein the compliance ring portion of the front diaphragm has a cross-sectional profile having a variable radius of curvature.

20. The transducer of claim 16, wherein the rear diaphragm has a disc-like shape comprising a central dome portion and an outer compliance ring portion.

21. The transducer of claim 20, wherein the compliance ring portion of the rear diaphragm has a cross-sectional profile having a variable radius of curvature.

22. The transducer of claim 16, wherein the cavity in the rear portion of the housing is separated into two portions via an acoustically resistive element.

* * * * *